US010842252B1

(12) United States Patent
Evans

(10) Patent No.: US 10,842,252 B1
(45) Date of Patent: Nov. 24, 2020

(54) WINDOW CLEANING CADDY HAVING ARTICULATING RESERVOIR

(71) Applicant: Richard Evans, San Diego, CA (US)

(72) Inventor: Richard Evans, San Diego, CA (US)

( * ) Notice: Subject to any disclaimer, the term of this patent is extended or adjusted under 35 U.S.C. 154(b) by 0 days.

(21) Appl. No.: 16/228,449

(22) Filed: Dec. 20, 2018

Related U.S. Application Data

(63) Continuation-in-part of application No. 29/640,855, filed on Mar. 16, 2018.

(60) Provisional application No. 62/608,377, filed on Dec. 20, 2017.

(51) Int. Cl.
*A45F 5/02* (2006.01)
*A47L 1/06* (2006.01)

(52) U.S. Cl.
CPC ..... *A45F 5/021* (2013.01); *A45F 2005/027* (2013.01); *A45F 2200/0566* (2013.01); *A45F 2200/0575* (2013.01); *A47L 1/06* (2013.01)

(58) Field of Classification Search
CPC .... A45F 3/00; A45F 3/02; A45F 5/021; Y10S 224/904
See application file for complete search history.

(56) References Cited

U.S. PATENT DOCUMENTS 2,893,615 A 5/1957 Couper
5,511,703 A * 4/1996 Ryerson ..... A41F 9/002 224/664
5,826,762 A * 10/1998 Dellinger ..... A45F 5/02 224/270
5,833,095 A * 11/1998 Russell ..... A45F 5/02 224/576
5,988,315 A * 11/1999 Crane ..... A45F 5/00 182/3
6,179,185 B1 * 1/2001 Dancyger ..... A45F 5/02 206/373
6,390,348 B1 * 5/2002 Godshaw ..... A45F 5/00 224/660
9,326,555 B1 * 5/2016 McKee ..... A41D 13/0012
9,463,662 B1 * 10/2016 Sotolongo ..... B44D 3/126
10,018,447 B1 7/2018 Alford
2002/0014507 A1 * 2/2002 Snider ..... A45F 5/02 224/671
2002/0145027 A1 * 10/2002 Godshaw ..... A45C 7/0086 224/605
2007/0241158 A1 * 10/2007 Shima ..... A45C 13/02 224/663
2008/0093406 A1 * 4/2008 Logan ..... A45F 3/14 224/682
2008/0179368 A1 * 7/2008 Williams ..... A45F 3/14 224/682

(Continued)

*Primary Examiner* — Brian D Nash
(74) *Attorney, Agent, or Firm* — Charmasson, Buchaca & Leach, LLP

(57) ABSTRACT

A caddy for carrying window cleaning accessories such as squeegees. The caddy can hang from the waistbelt of a user. The caddy can include a lower reservoir portion hingedly connected to an upper sleeve portion by a hinge. The sleeve loosely engages the oversized brim of the reservoir to form a peripheral drainage gap between the outer surface of the sleeve and the reservoir brim to trap liquids dripping over the outer surface of the sleeve. A releasable lock allows the reservoir to disengage from the sleeve, swing about the hinge and drain the liquid contents of the reservoir.

16 Claims, 5 Drawing Sheets

(56) References Cited

U.S. PATENT DOCUMENTS

| | | | | |
|---|---|---|---|---|
| 2009/0095751 | A1* | 4/2009 | Hamlin | A45C 13/1069<br>220/230 |
| 2014/0361063 | A1* | 12/2014 | Reed | A45F 5/021<br>224/682 |
| 2015/0014382 | A1* | 1/2015 | Hintze | A45F 5/021<br>224/661 |
| 2015/0237992 | A1* | 8/2015 | Kinskey | A45F 3/005<br>224/681 |
| 2016/0101646 | A1* | 4/2016 | Kiceniuk | B44D 3/126<br>224/191 |
| 2016/0120293 | A1* | 5/2016 | Davis | A45F 3/14<br>224/663 |

* cited by examiner

WINDOW CLEANING CADDY HAVING ARTICULATING RESERVOIR

PRIOR APPLICATION

This application claims the benefit of U.S. provisional utility patent application Ser. No. 62/608,377, filed 2017 Dec. 20, and a continuation-in-part of U.S. design patent application Serial No. 29640855, filed 2018 Mar. 16, both of which are incorporated herein by reference.

FIELD OF THE INVENTION

The instant invention relates to body-worn harnesses, holsters, belts or other garments for carrying items, and more particularly to devices for carrying window cleaning equipment on the body.

BACKGROUND

Window cleaning or washing, particularly on high-rise commercial buildings, can be a difficult and often dangerous task requiring skill, expertise and specialized equipment. An important piece of that equipment is often one or more rubber-bladed wiping devices, each known as a squeegee. Squeegees of different sizes can be used for different applications. Often a user will carry two or more squeegees.

When working on an elevated platform, workers often carrying a full load of items to avoid the time-consuming descent to retrieve some omitted item. In order to perform their tasks more efficiently, window cleaning personnel often carry a number of items for ready access, including, but not limited to one or more squeegees, handled mops, sponges, scrapers, steel wool, solvent applicators, buckets, hoses, soap containers, and wiping rags. Further, bulky items such as larger squeegees and extension poles can all take up limited space on the elevated platform.

In order to organize and provide ready access to the large number of items used by window cleaning personnel, various harnesses, caddies, holsters, specialized work clothes and other item carriers may have been proposed. Many of such carriers are bulky, expensive, are not versatile enough to carry different items, and do not securely hold items while allowing for easy and rapid removal of items.

One major problem with many prior body-worn window cleaning item carriers is that they do not efficiently trap the drips of liquid falling from the squeegee loaded into the carrier. Inadvertent drips falling on previously cleaned section of windows can greatly reduce efficiency by causing the cleaner to have to re-clean the window pane hit by the drip.

Therefore, there is a need for a body-worn, window cleaning caddy which addresses some or all of the above identified inadequacies.

SUMMARY

The principal and secondary objects of the invention are to provide an improved cleaning supplies caddy. These and other objects are achieved by a squeegee caddy having an articulateable, drip-catching reservoir.

In some embodiments there is provided a window cleaning supplies caddy which comprises: a back panel elongated along an axis; said back panel having an axial upper end and an opposite axial lower end; a sleeve formed near said upper end; a bucket formed near said lower end; said sleeve having an open top inlet bordered by a rim, and an open bottom outlet; a hinge between said sleeve and said bucket allowing relative motion of the sleeve and bucket between an engaged configuration and a disengaged configuration.

In some embodiments said bucket has a top opening bordered by a brim and a closed bottom; said top opening being shaped and dimensioned to axially and loosely engage said outlet; and, said top opening being further shaped and dimensioned to include a peripheral gap between said sleeve and said lip while said bucket is in said closed position.

In some embodiments back panel comprises a band of flexible sheet material.

In some embodiments said back panel is flexible between an arcuate configuration wherein a lateral cross-section has an arcuate shape and flattened configuration wherein said lateral cross-section has a substantially linear shape.

In some embodiments said top opening being further shaped and dimensioned to allow angular movement of said bucket about said hinge without interference from contact with said sleeve.

In some embodiments said outlet extends axially below said lip while said bucket is in said engaged configuration.

In some embodiments said caddy further comprises a releasable lock for locking said bucket in said engaged configuration.

In some embodiments said caddy further comprises: said bucket has a shape which tapers to become narrower from said top opening toward said closed bottom; and, wherein said engaged configuration is adjustable to narrow said peripheral gap by more deeply engaging said top opening into said outlet.

In some embodiments said caddy further comprises: a squeegee; and, wherein said top inlet is shaped and dimensioned to allow insertion of an arm of said squeegee therethrough.

In some embodiments said rim has a notch shaped and dimensioned to nest a handle of said squeegee therein.

In some embodiments said sleeve and said bucket have an integrated posterior concave surface for nesting against the thigh of a user.

In some embodiments said brim comprises a spout.

In some embodiments an outer surface of said sleeve comprises a hydrophillic, high water adhesion material for directing a flow of liquid along an outer surface of said sleeve through said peripheral gap.

In some embodiments said caddy further comprises a fastening rig attached to said sleeve.

In some embodiments said caddy further comprises at least one tubular retainer formed against the forward facing surface of the back panel and within the sleeve.

In some embodiments there is provided a window cleaning supplies caddy which comprises: a sleeve elongated along an axis; said sleeve having an open top inlet bordered by a rim, and an open bottom outlet; a bucket having a top opening bordered by a brim and a closed bottom; said top opening being shaped and dimensioned to axially and loosely engage said open bottom outlet; said top opening being further shaped and dimensioned to include a peripheral gap between said sleeve and said brim.

In some embodiments said caddy further comprises: a hinge rotatively connecting said bucket to said sleeve; said hinge allowing relative movement of said bucket with respect to said sleeve between an engaged configuration and a disengaged configuration.

In some embodiments there is provided a method for carrying a window cleaning squeegee, said method comprises: selecting a body-worn caddy having a sleeve and a bucket rotatably connected to said sleeve at a hinge; inserting an arm of a squeegee through said sleeve and into said bucket; awaiting drips of cleaning liquid to drain off of said squeegee; wherein said awaiting comprises: flowing of said drips over an outer surface of said sleeve and into said bucket; and, rotating said bucket about said hinge to drain said drips from said bucket.

The original text of the original claims is incorporated herein by reference as describing features in some embodiments.

DESCRIPTION OF THE EXEMPLARY EMBODIMENTS

Figure 1:
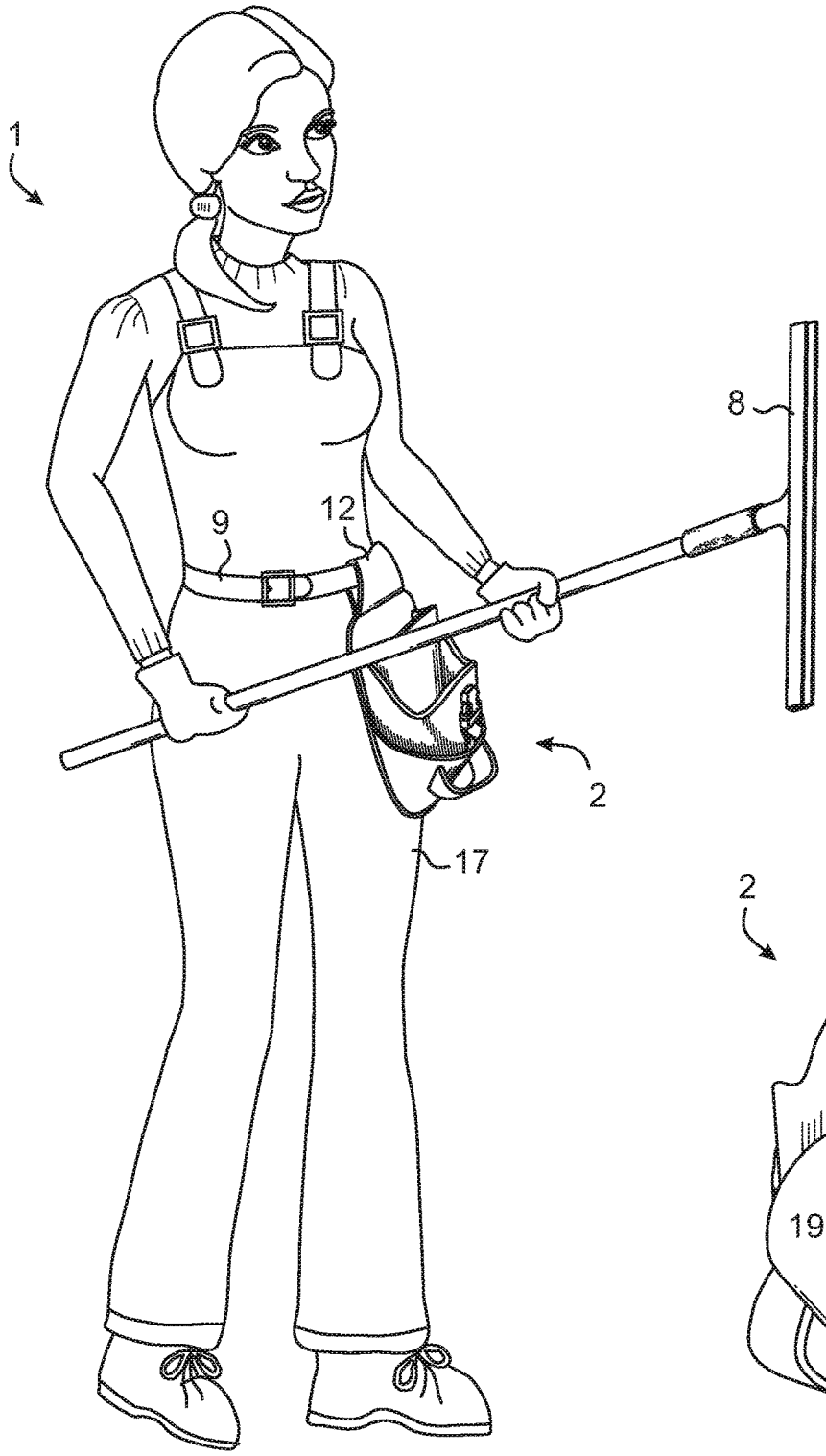
FIG. 1 is a diagrammatic perspective view of a squeegee caddy according to an exemplary embodiment of the invention carried by a user.

In this specification, the references to top, bottom, upward, downward, upper, lower, vertical, horizontal, sideways, lateral, back, front, etc. are used to provide a clear frame of reference for the various structures with respect to other structures while the caddy is being worn by a user as shown in FIG. 1, and not treated as absolutes when the frame of reference is changed, such as when the caddy is laying on the ground unworn.

The term "substantially" is used in this specification because manufacturing imprecision and inaccuracies can lead to non-symmetricity and other inexactitudes in the shape, dimensioning and orientation of various structures. Further, use of "substantially" in connection with certain geometrical shapes and orientations, such as "parallel" and "perpendicular", can be given as a guide to generally describe the function of various structures, and to allow for slight departures from exact mathematical geometrical shapes and orientations, while providing adequately similar function. Those skilled in the art will readily appreciate the degree to which a departure can be made from the mathematically exact geometrical references.

Referring now to the drawing, there is shown in FIG. 1 a caddy 2 for carrying a squeegee 8 among other items according to an exemplary embodiment of the invention. The caddy can include an upper fastening rig such as a belt loop 12 which may be laterally engaged by a waist belt 9 worn by a user 1.

Figure 2:
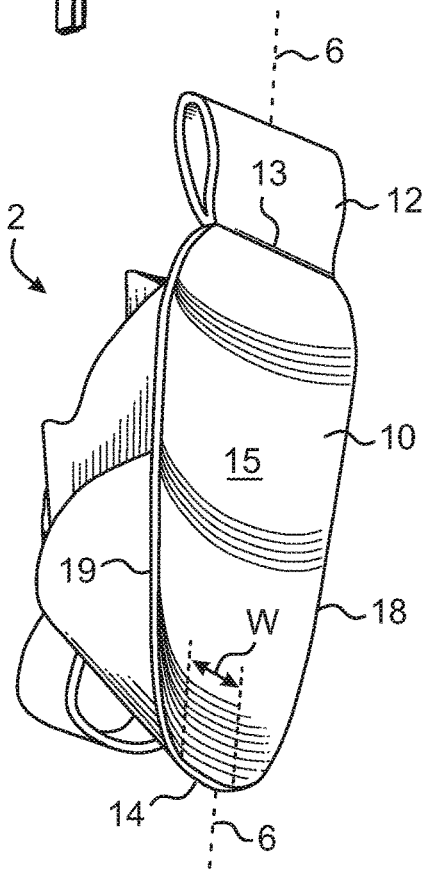
FIG. 2 is a diagrammatic perspective view of the back of the squeegee caddy showing its concave back surface.

As shown in FIG. 2, the caddy 2 can include an arcuate back panel 10 forming a concave outer rear surface 15 for comfortably and securely nesting against the user's upper leg 17. The back panel can have an oblong, rounded shape extending along a vertical axis 6 between a top end 13 and a bottom end 14, and having a pair of lateral sides 18,19. The belt loop 12 can extend upwardly from the top end.

Figure 3:
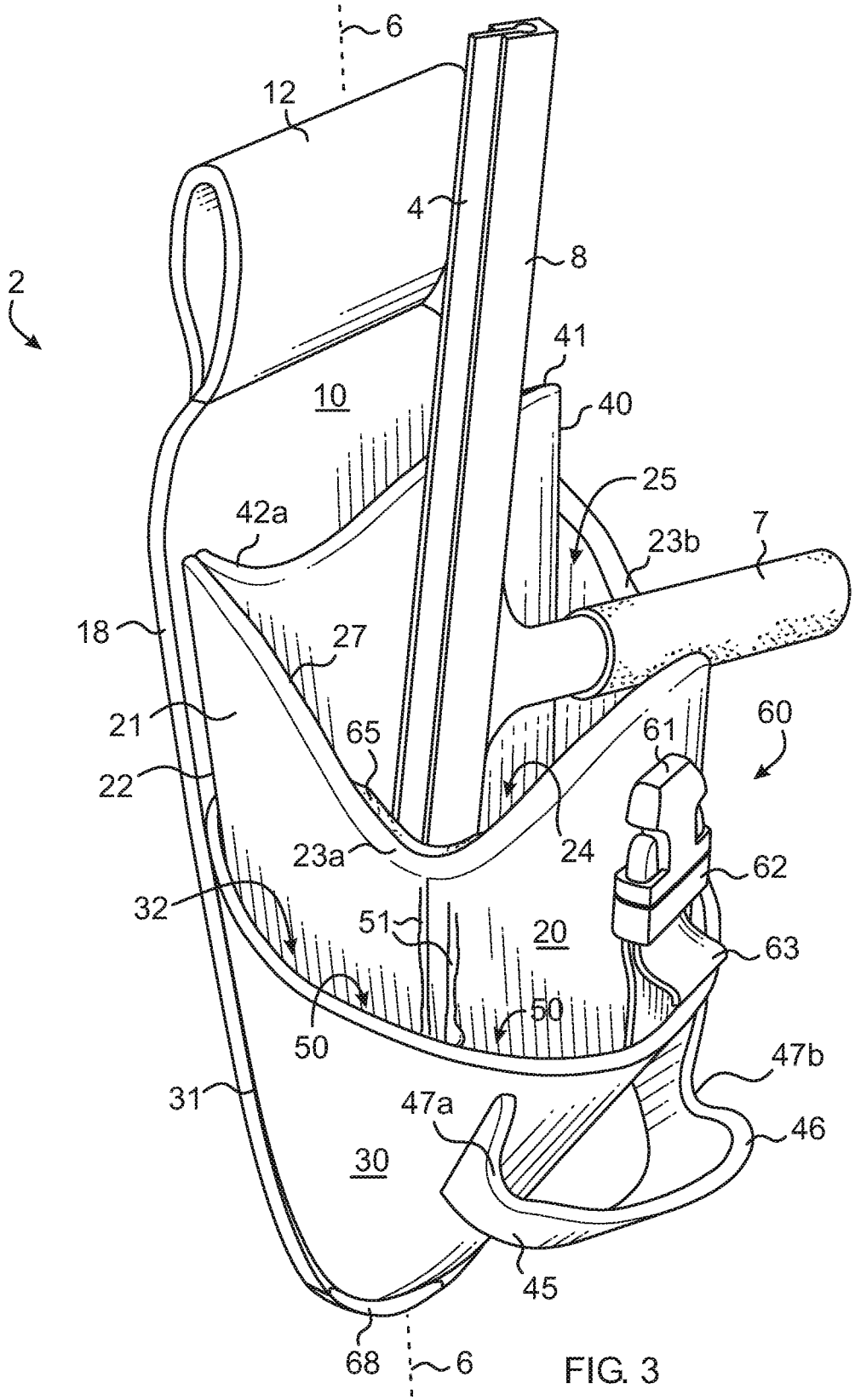
FIG. 3 is a diagrammatic perspective view of the caddy of FIG. 1 in the closed, bucket engaged configuration and carrying a squeegee.
Figure 4:
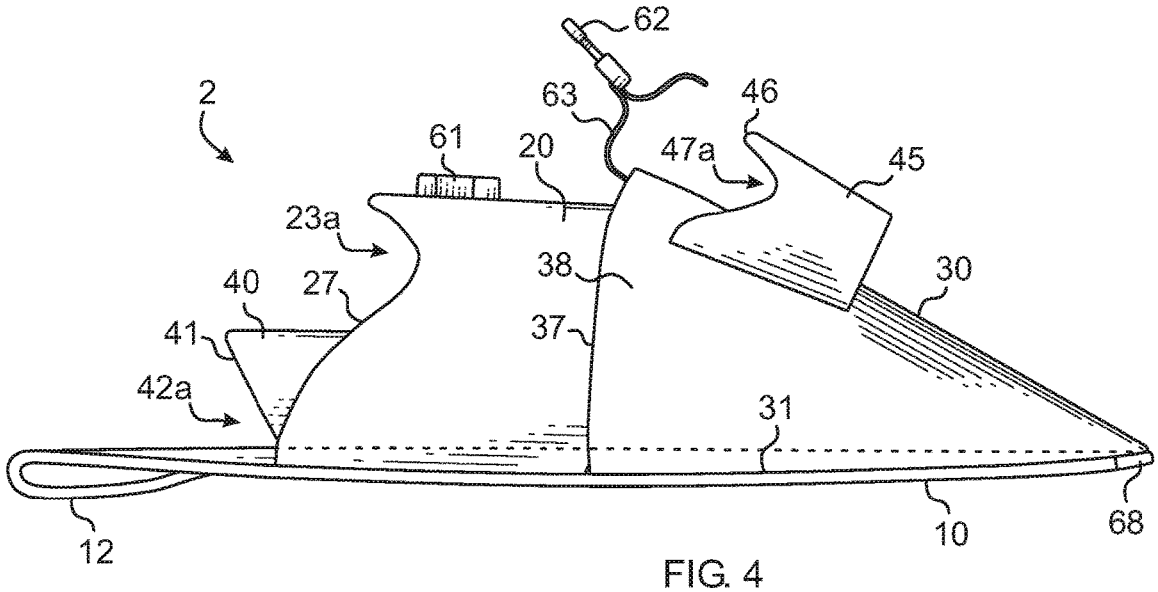
FIG. 4 is a diagrammatic side elevation view of the caddy of FIG. 1 in the closed, bucket engaged configuration.
Figure 5:
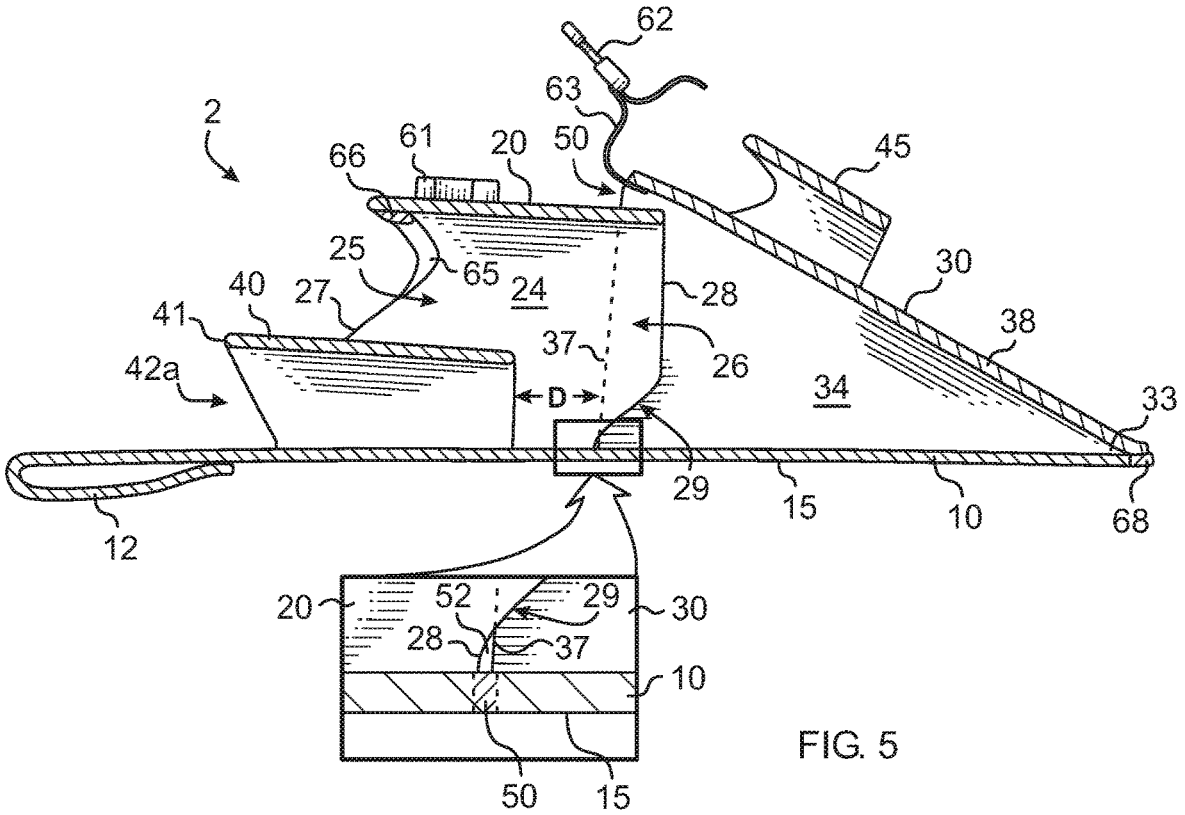
FIG. 5 is a diagrammatic cross-sectional side view of the caddy of FIG. 1 in the closed, bucket engaged configuration.
Figure 6:
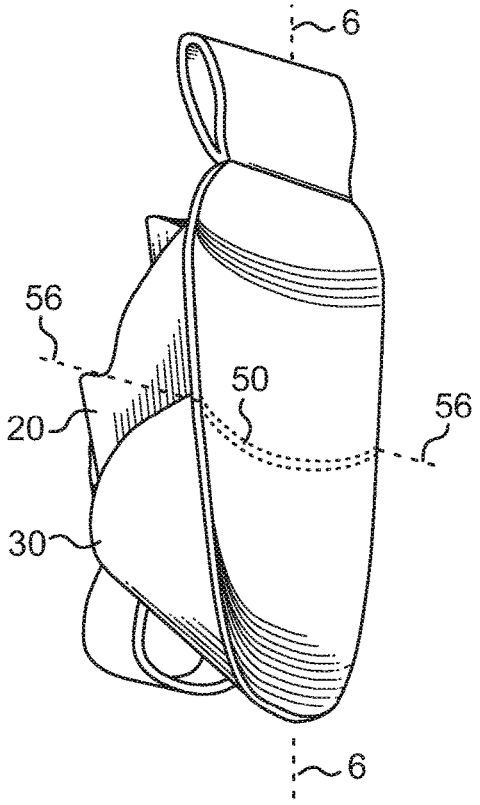
FIG. 6 is a diagrammatic perspective view of the back of the squeegee caddy showing its concave back surface and band of material forming the hinge.

As shown in FIGS. 3-5, the caddy 2 can include an upper portion forming a tubular hollow retaining sleeve 20 and a lower portion forming a liquid trapping bucket 30. The sleeve can be formed by a curved piece of rigid sheet material 21 having its lateral edges 22 (in FIG. 3, the far edge is hidden) attached to and sealed against the front surface of the back panel 10 near its lateral sides 18,19. The inside surfaces of the sleeve can have a layer of waterproof material such as 18 ounce vinyl sheeting. In this way, the sleeve 20 can form a waterproof inner passageway 24 which extends axially between an open top inlet 25 and an open lower outlet 26. Part of the top inlet can be bordered by an undulating upper lip 27 while part of the lower outlet can be bordered by a lower lip 28. The upper lip can have a pair of downwardly extending lateral notches 23*a*,23*b* shaped and dimensioned to have a generally rounded shape of a given radius in order to securely nest the typically cylindrical handle 7 of the squeegee 8 therein.

The bucket 30 can be formed by a curved piece of rigid sheet material having a shape similar to a partial cone having a curved wall 38 whose lateral and bottom edge 31 is attached to and sealed against the front surface of the back panel 10 near its lateral sides 18,19 and bottom edge 14. The inside surface of the bucket can have a layer of waterproof material such as 18 ounce vinyl sheeting. In this way, the bucket can have a curved top opening 32 bordered by a brim 37 leading to a waterproof internal reservoir 34 which can have a downwardly tapering substantially rounded wedge or conic shape so that the bottom of the reservoir terminates in a narrow pit 33 for capturing the narrow end of a squeegee arm or the end or a mop handle for example. The pit can be laterally dimensioned to have a width W (shown in FIG. 2) in order to allow space for the rubber blade 4 of a squeegee to rest therein, while avoiding crimping and forcing early replacement of the blade.

The combination of the tapered bucket 30, the narrower inner passageway 24 of the sleeve 20, and the notches 23*a*,23*b* in the upper lip 27 serve to capture the squeegee 8 while carried in the caddy, but also allow for rapid removal and use of the squeegee. Captured items are less likely to rattle during walking movement of the user and the swinging of the caddy. The inside surfaces of the bucket and sleeve can be smooth allowing unobstructed sliding and guiding of any oblong item such as a squeegee arm down through the sleeve passageway, bucket, and into the pit.

The shape and dimensioning of the brim 37 of the bucket 30 can be oversized with respect to the lower lip 28 of the sleeve 20 allowing the brim to be loosely engaged by the sleeve. This loose engagement can provide a peripheral drainage gap 49 between the brim and the lower lip to allow the unimpeded passage of drips 51 therethrough and on into the bucket to be trapped in the reservoir 34. The loose engagement also allows the bucket to swing between the bucket-engaged and bucket disengaged configurations without interference. The gap also allows for insertion of additional tools such as squeegee arms therethrough.

The sleeve 20 can include an outer surface veneer layer of relatively hydrophillic, high water adhesion material such as ballistic nylon. This material allows the outer surface of the sleeve to retain and direct liquid droplets downwardly toward the lower end, through the gap and into the bucket portion instead of glancing off the outer surfaces of the caddy and onto clean windows. The outer surfaces of the entire caddy can include a layer of hydrophillic material such as ballistic nylon to act as a kind of sponge to further prevent unwanted drips by capturing and dispensing liquids, and upon saturation of a local zone, guiding additional water downward while maintaining adhesion.

A tubular organizing retainer 40 can be formed against the forward facing surface of the back panel and within the sleeve 20. The front portion of the retainer can form a laterally extending vertical septum separating the inner passageway of the retainer from an inner passageway 24 of the sleeve, and thereby narrow the upper passageway of the sleeve. The retainer can be shaped and dimensioned to secure a mop handle and squeegee arm in a side-by-side configuration to further secure and organize the items in place within the caddy. The retainer has smooth inside and outside surfaces to avoid snags and other obstructions during insertion of items through the retainer or outside the retainer and into the sleeve. A top rim 41 has a pair of opposite lateral clefts 42*a* (far cleft hidden) for capturing the laterally projecting handles of items such as squeegees. The clefts can be located against the back panel in order to prevent the handles of squeegees held by the retainer to interfere with the handles of squeegees held by the notches 23*a*,23*b* in the upper lip 27 of the sleeve. A bottom rim 43 of the retainer terminates an axial distance D from the brim 37 of the bucket 30 in order to avoid rigidizing the back panel 10 near the bucket. Such rigidization would tend to prevent the back panel from having the flexibility to form a hinge as will be described below. One or more retainers can be provided to more completely organize and secure tools engaging the sleeve.

A tool loop 45 is secured to the outside surface of the bucket 30 to capture additional tools and to act as a graspable handle for manipulating the bucket during a bucket dumping process described below. A top rim 46 of the loop can have a pair of opposite lateral clefts 47*a*,47*b* for capturing the laterally projecting handles of items such as squeegees.

The bucket 30 and sleeve 20 can be hingedly interconnected at a hinge 50 which allows relative angular movement between the bucket and sleeve about a substantially transverse rotation axis 56 which can be substantially perpendicular to the vertical axis 6 of the caddy 2. The hinge 50 can be formed by a web or band of flexible material forming part of the back panel 10.

As shown primarily in the enlarged part of FIG. 5, in order to maintain the flexibility of the hinge 50, the lower lip 28 of the sleeve 20 includes a pair of slits 29 where the lateral edges 22 connect to the back panel 10, so that a separation 52 exists between the axial extents of the lower lip and the brim 37 of the bucket 30. In other words, both the bucket and sleeve tend to stiffen the structure of the back panel. The stiffening influence of the bucket and sleeve is reduced by terminating those structures near the band of material forming the hinge. Further, in this way the sleeve and bucket have an integrated posterior concave surface for nesting against the thigh of a user.

Figure 8:
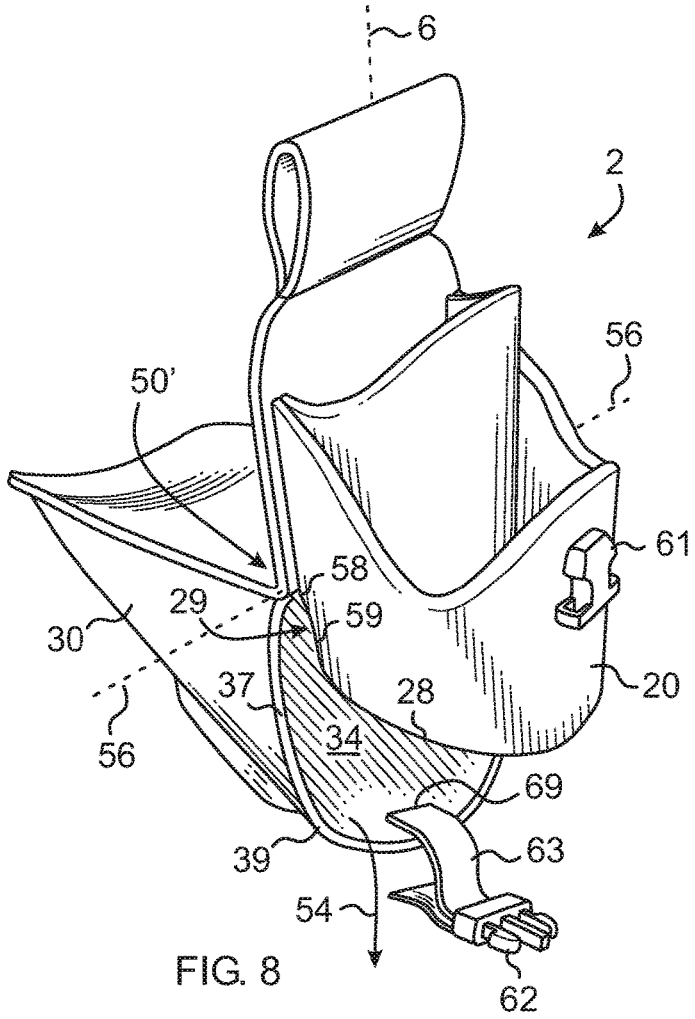
FIG. 8 is a diagrammatic perspective view of the back of the squeegee caddy in the open, reservoir disengaged configuration.
Figure 7:
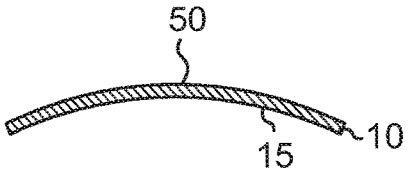
FIG. 7 is a diagrammatic cross-sectional side view of the hinge in the closed, bucket engaged configuration.
Figure 9:
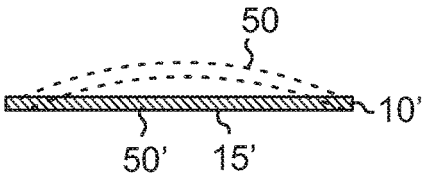
FIG. 9 is a diagrammatic cross-sectional side view of the hinge in the open, reservoir disengaged configuration.

In a typical in-use, bucket-engaged configuration as shown in FIGS. 1-7, the bucket 30 is engaged by the sleeve 20, and the back panel 10 has a concave back surface 15. In this configuration the band of flexible material forming the hinge 50 is curved as shown in FIG. 7. However, as shown in FIG. 8, when the bucket gets full, and needs to be drained, the outer, free edge 39 of the bucket brim 37 can swing downwardly, causing the bucket to rotate about the rotational axis 56 of the hinge 50,50'. At the full extent of its swinging arc, while the caddy is in its emptying, bucket disengaged configuration, the contents of the reservoir 34 can be emptied 54. In this configuration the band of flexible material forming the hinge 50' is flattened as is the inner surface 15' of the back panel 10' as shown in FIG. 9. For illustrative purposes, the dotted line shows the previous shape of the band 50 while the caddy is in the bucket-engaged configuration. Thus, the back panel can be flexible enough to change its shape from being curved in the bucket-engaged configuration to being substantially flat in the bucket-disengaged configuration. The back panel can bend longitudinally at a temporary crease formed by the hinge allowing a joint to be formed between the sleeve and the bucket. It can be counterintuitive to place a latitudinally concave shape in an item which is intended to bend longitudinally.

The bucket 30 is held in the bucket-engaged configuration by a lock 60 which can be formed by a side release snap-fit buckle including a catch member 61 secured to an outer surface of the caddy such as on the sleeve 20, and a hook member 62 adjustably secured to a flexible strap 63 which is attached at a lower terminus 69 to the inner surfaces of the bucket.

By being adjustable, the lock 60 allows the position of the bucket 30 in its bucket-engaged configuration to be adjusted so that the lower lip 28 more deeply engages the tapered walls of the bucket and thus narrows the gap 69 between the sleeve 20 and bucket. A narrower gap can help prevent liquid from sloshing out of the bucket when it becomes full and when squeegee arms are not present to act as baffles to the trapped liquid. A wider gap allows more tools to be inserted into the gap for additional storage.

By locating the terminus inside the bucket, drips from the lock are guided into the bucket reservoir. The curved free edge 39 of the bucket in combination with the attached strap acts as a spout for directing a stream of liquid from the reservoir in a controlled manner. The shape of the free edge can include a front notch or other structure to improve the spout.

It should be noted that the pair of slits 29 on the posterior edge of the lower lip 28 of the sleeve 20 where it joins to the back panel 10 can include a continuous, downwardly sloping edge 59 from the point of contact 58 with the back panel. The slits, in combination with the hydrophillic material layer on the outside surface of the sleeve, causes drips to be carried away from the band of material forming the hinge 50,50'. In this way the caddy avoids drips caused during motion of the bucket about the hinge. It also avoids pinch points which can tend to trap liquid and saturate and foul the binding between the back panel and the parts of the bucket and sleeve contacting the back panel near the hinge.

The back panel 10 of the caddy can be formed from an oblong piece of semirigid laminar material such as a layer of durable, flexible plastic sandwiched between layers of 18 ounce vinyl sheeting and ballistic nylon. This allows the necessary flexibility of the back panel to act as a hinge 50 for angularly displacing the bucket 30 with respect to the sleeve 20. Alternately, it shall be understood that the back panel can be formed by separate rigid arcuate panels joined by a flexible web forming the hinge.

The upper lip 27 of the sleeve portion 20 can include edge guards 65 made of compressible material such as foam rubber having a durometer of between about 40 A and 80 A. The edge guards can be glued to the edges and the outer surface layers sewn over. The compressible edge guards can have an enlarged axial cross-section 66 so that a wider surface area is provided for the rubber blades of the squeegee to rest against. In this way the flatness of the squeegee blade is protected, thereby reducing the incidence of replacement.

A bottom toe guard 68 of more durable material than the back panel, such as hard plastic or steel can be formed onto the bottom outer tip of the bucket, as this site is often a point of high wear.

In this way the squeegee caddy can conveniently carrying a number of wet or soaking window cleaning items such as squeegees on a user's belt. The caddy can be made from substantially rigid, durable fabric sheet material, and thus the entire caddy can be machine washed.

Figure 10:
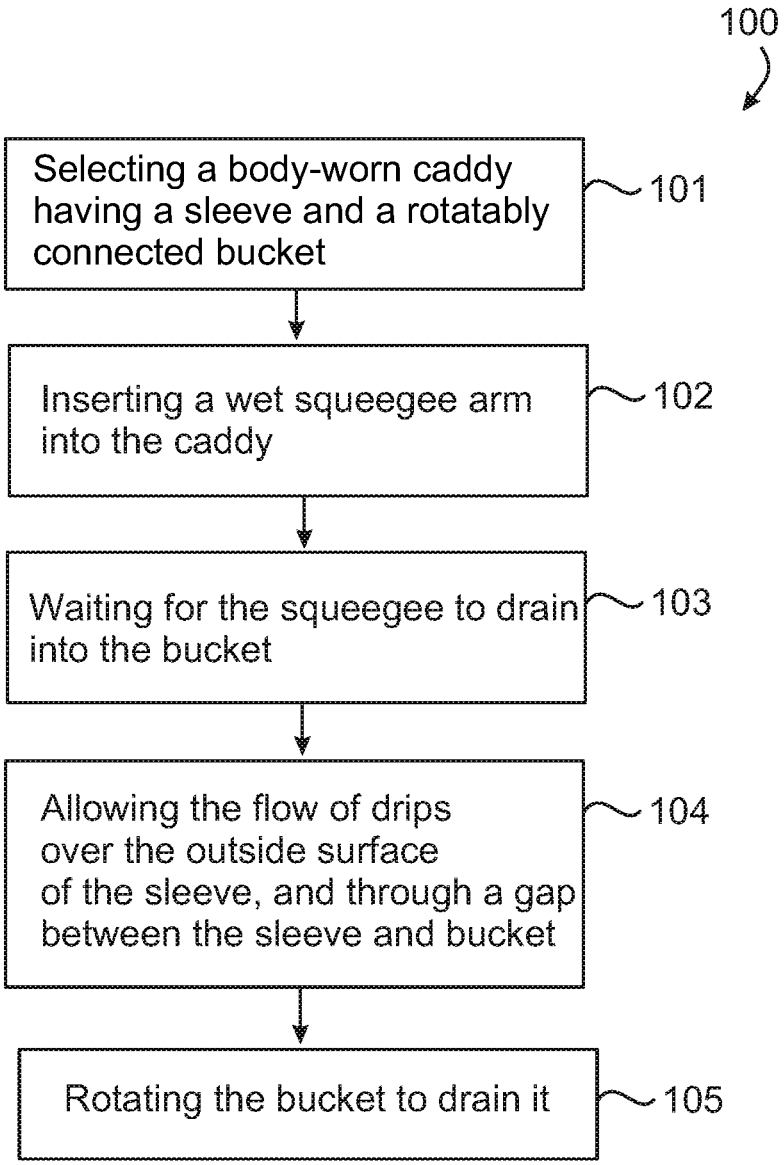
FIG. 10 is a block diagram of a method for carrying a squeegee according to an exemplary embodiment of the invention.

Referring now to FIG. 10, there is shown an exemplary embodiment for a method 100 for carrying a window cleaning squeegee. The method steps include selecting 101 a body-worn caddy having a sleeve and a bucket rotatably connected to the sleeve at a hinge; inserting 102 the wet arm of a squeegee through the sleeve and into the bucket; waiting 103 for drips of cleaning liquid to drain off of the squeegee and flow 104 along an outer surface of the sleeve before passing through a gap between the sleeve and the bucket brim, then on into the bucket. Once the bucket contains enough liquid, the bucket can be rotated 105 about said hinge to drain the bucket.

While the preferred embodiments of the invention have been described, modifications can be made and other embodiments may be devised without departing from the spirit of the invention and the scope of the appended claims.

What is claimed is:

1. A window cleaning supplies caddy comprises:
a back panel elongated along an axis;
said back panel having an axial upper end and an opposite axial lower end;
a sleeve formed near said upper end;
a bucket formed near said lower end;
said sleeve having an open top inlet bordered by a rim, an inner passageway, and an open bottom outlet allowing liquid to exit said sleeve through said inner passageway, out said bottom outlet into said bucket;
said bucket has a top opening bordered by a brim and a closed bottom;
said top opening being shaped and dimensioned to axially and loosely engage said outlet; and,
said top opening being further shaped and dimensioned to include a peripheral gap between said sleeve and said lip while said bucket is in said closed position, thereby allowing liquid to flow along an outer surface of said sleeve through said peripheral gap and into said bucket; and,
a hinge between said sleeve and said bucket allowing relative motion of the bucket with respect to said sleeve between an engaged configuration and a disengaged configuration.

2. The caddy of claim 1, wherein back panel comprises a band of flexible sheet material.

3. The caddy of claim 1, wherein said back panel is flexible between an arcuate configuration wherein a lateral cross-section has an arcuate shape and flattened configuration wherein said lateral cross-section has a substantially linear shape.

4. The caddy of claim 1, wherein said top opening being further shaped and dimensioned to allow angular movement of said bucket about said hinge without interference from contact with said sleeve.

5. The caddy of claim 1, wherein said outlet extends axially below said lip while said bucket is in said engaged configuration.

6. The caddy of claim 1, which further comprises a releasable lock for locking said bucket in said engaged configuration.

7. The caddy of claim 6, which further comprises:
said bucket has a shape which tapers to become narrower from said top opening toward said closed bottom; and,
wherein said engaged configuration is adjustable to narrow said peripheral gap by more deeply engaging said top opening into said outlet.

8. The caddy of claim 1, which further comprises:
a squeegee; and,
wherein said top inlet is shaped and dimensioned to allow insertion of an arm of said squeegee therethrough.

9. The caddy of claim 8, wherein said rim has a notch shaped and dimensioned to nest a handle of said squeegee therein.

10. The caddy of claim 1, wherein said sleeve and said bucket have an integrated posterior concave surface for nesting against the thigh of a user.

11. The caddy of claim 1, wherein said brim comprises a spout.

12. The caddy of claim 1, wherein an outer surface of said sleeve comprises a hydrophillic, high water adhesion material.

13. The caddy of claim 1, which further comprises a fastening rig attached to said sleeve.

14. A window cleaning supplies caddy comprises:
a back panel elongated along an axis;
said back panel having an axial upper end and an opposite axial lower end;
a sleeve formed near said upper end;
a bucket formed near said lower end;
said sleeve having an open top inlet bordered by a rim, an inner passageway, and an open bottom outlet allowing liquid to exit said sleeve through said inner passageway, out said bottom outlet into said bucket;
said bucket has a top opening bordered by a brim and a closed bottom;
said top opening being shaped and dimensioned to axially and loosely engage said outlet; and,
said top opening being further shaped and dimensioned to include a peripheral gap between said sleeve and said lip while said bucket is in said closed position, thereby allowing liquid to flow along an outer surface of said sleeve through said peripheral gap and into said bucket; and,
at least one tubular retainer formed against the forward facing surface of the back panel and within the sleeve.

15. A window cleaning supplies caddy comprises:
a sleeve elongated along an axis;
said sleeve having an open top inlet bordered by a rim, an inner passageway, and an open bottom outlet;
a bucket having a top opening bordered by a brim and a closed bottom;
said top opening being shaped and dimensioned to axially and loosely engage said open bottom outlet;
said top opening being further shaped and dimensioned to include a peripheral gap between said sleeve and said brim;
thereby allowing a first flow of liquid from said sleeve through said inner passageway, out said open bottom outlet into said bucket, and allowing a second flow of liquid over an outer surface of said sleeve, through said peripheral gap into said bucket; and a hinge rotatively connecting said bucket to said sleeve;

said hinge allowing relative movement of said bucket with respect to said sleeve between an engaged configuration and a disengaged configuration.

16. A method for carrying a window cleaning squeegee, said method comprises:

selecting a body-worn caddy having a sleeve and a bucket rotatably connected to said sleeve at a hinge;

inserting a wet arm of a squeegee through said sleeve and into said bucket;

awaiting drips of cleaning liquid to drain off of said squeegee;

wherein said awaiting comprises:

flowing of said drips though an inner passageway of said sleeve and into said bucket;

flowing of said drips over an outer surface of said sleeve and into said bucket; and, rotating said bucket about said hinge to drain said drips from said bucket.

* * * * *